US010386167B2

(12) United States Patent
Noble

(10) Patent No.: US 10,386,167 B2
(45) Date of Patent: Aug. 20, 2019

(54) AMMUNITION CONTAINER WITH IMPROVED LATCHING AND SEALING ARRANGEMENTS

(71) Applicant: General Dynamics—OTS, Inc., St. Petersburg, FL (US)

(72) Inventor: Thomas Noble, Fairfax, VT (US)

(73) Assignee: General Dynamics—OTS, Inc., St. Petersburg, FL (US)

( * ) Notice: Subject to any disclaimer, the term of this patent is extended or adjusted under 35 U.S.C. 154(b) by 279 days.

(21) Appl. No.: 15/420,453

(22) Filed: Jan. 31, 2017

(65) Prior Publication Data

US 2017/0248397 A1 Aug. 31, 2017

Related U.S. Application Data

(60) Provisional application No. 62/300,580, filed on Feb. 26, 2016.

(51) Int. Cl.

| | |
|---|---|
| ***B65D 55/00*** | (2006.01) |
| ***F42B 39/26*** | (2006.01) |
| ***F42B 39/14*** | (2006.01) |
| ***B65D 55/04*** | (2006.01) |
| ***B65D 53/02*** | (2006.01) |
| ***B65D 45/32*** | (2006.01) |

(52) U.S. Cl.

CPC ..... *F42B 39/26* (2013.01); *B65D 45/32* (2013.01); *B65D 53/02* (2013.01); *B65D 55/04* (2013.01); *F42B 39/14* (2013.01)

(58) Field of Classification Search

CPC ..... F42B 39/26; F42B 39/14; B65D 45/32; B65D 53/02; B65D 55/04

USPC ..... 206/3

See application file for complete search history.

(56) References Cited

U.S. PATENT DOCUMENTS

| | | | | | |
|---|---|---|---|---|---|
| 2,040,024 | A | * | 5/1936 | Roberts | B65D 45/345 220/321 |
| 2,052,491 | A | * | 8/1936 | Rueppel | F42B 39/00 206/3 |
| 2,916,141 | A | * | 12/1959 | Arnot | B65D 90/0053 206/386 |
| 3,425,586 | A | * | 2/1969 | Claus | B65D 21/0201 220/23.4 |
| 3,939,967 | A | * | 2/1976 | Tenney | B65D 81/02 206/3 |
| 4,055,247 | A | * | 10/1977 | Benedick | F42B 39/14 206/3 |
| 4,279,339 | A | * | 7/1981 | Gotter | F42B 39/00 206/3 |
| 4,347,929 | A | * | 9/1982 | Poe | F42B 39/30 206/3 |

(Continued)

*Primary Examiner* — Ernesto A Grano

(74) *Attorney, Agent, or Firm* — Lorenz & Kopf, LLP

(57) ABSTRACT

Ammunition containers incorporate an advanced sealing/latching arrangement as well as a lightning mitigation scheme that exhibits a number of advantageous features. A cover assembly is provided that separates the latching functionality from the sealing functionality such that the latching assembly is rotatably engaged and the cover seal is provided via radial (rather than axial) compression of an annular sealing component. In addition, a novel lightning mitigation system also functions as a convenient method of grasping and transporting the containers.

18 Claims, 13 Drawing Sheets

(56) References Cited

U.S. PATENT DOCUMENTS 4,356,913 A * 11/1982 Moraine ..... F42B 39/26 206/3
4,566,588 A * 1/1986 Kataczynski ..... B65D 71/0096 206/3
4,693,278 A * 9/1987 Wilson ..... F16L 55/136 138/89
4,733,773 A * 3/1988 LaBianca ..... F42B 39/00 206/3
4,762,222 A * 8/1988 Martin ..... F42B 39/22 206/3
4,768,418 A * 9/1988 Blommer ..... F42B 39/24 206/3
4,785,930 A * 11/1988 Fischer ..... F42B 39/00 206/3
4,979,632 A * 12/1990 Lee ..... F42B 39/14 206/3
4,989,493 A * 2/1991 Blommer ..... F42B 39/24 102/374
5,779,031 A * 7/1998 Moraine ..... F42B 39/00 206/3
6,290,087 B1 * 9/2001 Shacklee ..... F42B 39/00 206/509
6,357,582 B1 * 3/2002 Fischer ..... F42B 39/00 206/3
6,568,330 B1 * 5/2003 Kaiserman ..... F41F 3/00 102/374
6,772,877 B1 * 8/2004 Lam ..... F42B 39/00 206/3
6,901,838 B2 * 6/2005 Dieling ..... F41F 3/042 89/1.804
7,036,419 B2 * 5/2006 Vallier ..... F41F 3/042 89/1.816
7,121,401 B1 * 10/2006 Sinha ..... F42B 39/02 206/3
7,308,981 B1 * 12/2007 Noel Du Payrat ..... F42B 39/00 206/3
7,422,102 B1 * 9/2008 Lam ..... F42B 39/00 206/3
7,546,917 B1 * 6/2009 Lam ..... B65D 71/70 206/3
D600,998 S * 9/2009 De Maria ..... D8/336
9,616,313 B2 * 4/2017 Townsend ..... A45C 9/00
9,726,288 B2 * 8/2017 Kegler ..... E05B 65/006
9,841,256 B2 * 12/2017 Teetzel ..... F41F 3/077
9,874,420 B2 * 1/2018 Miller ..... F41F 3/042
9,874,427 B2 * 1/2018 Karlsson ..... F42B 39/14
10,113,846 B2 * 10/2018 Pitre ..... F42B 39/20
2002/0134693 A1 * 9/2002 Boutet ..... F42B 39/00 206/3
2002/0185386 A1 * 12/2002 Brase ..... F42B 39/00 206/3
2004/0084330 A1 * 5/2004 Borngen ..... F42B 39/00 206/3
2010/0170808 A1 * 7/2010 Sundvall ..... F41F 3/042 206/3
2010/0236945 A1 * 9/2010 Johnson ..... F42B 39/24 206/3
2013/0340662 A1 * 12/2013 Shinkai ..... B63B 27/36 114/50

* cited by examiner

AMMUNITION CONTAINER WITH IMPROVED LATCHING AND SEALING ARRANGEMENTS

CROSS-REFERENCE TO RELATED APPLICATIONS

This application claims priority to Provisional Patent Application Ser. No. 62/300,580, filed Feb. 26, 2016, the contents of which are hereby incorporated by reference.

TECHNICAL FIELD

Embodiments of the subject matter described herein relate generally to ammunition containers and, more particularly, to ammunition containers with improved structures relating to lightning mitigation, latching and sealing arrangements, and the like.

BACKGROUND

Ammunition containers are often employed to store and transport rockets, missiles, and other such ammunition in a way that protects them from environmental conditions such as moisture, debris, and electrical storms. It is also desirable for the cover assembly of the container to be relatively easy to open and close by the operator while still providing a secure, sealed environment for the enclosed ammunition.

In this regard, prior art ammunition containers may be undesirable in a number of respects. For example, it is common for the cover assemblies of such containers to be sealed via a compressive, axial force applied to the cover, which causes axial deformation of a sealing ring of some type. A latch is then engaged to hold the cover in place and to counteract the axial force resulting from the seal. That is, the compressive force applied by the latch needs to accomplish two separate tasks: sealing the container (via compression of the seal) and keeping the container closed and latched. Such a system often requires the operator to use two hands and in some cases require tools to open and close the container cover.

A major consideration in the storage and transportation of ammunition is preventing the ammunition from initiating in the presence of fire. Ammunition container materials that melt in such an environment are desirable because they ensure that pressure cannot build up and cause explosive materials to auto-ignite. Toward that end, plastic containers would generally be preferred. However, in the case of ammunition containers manufactured from a non-conductive material, such as plastic, it is desirable to incorporate some form of lightning protection to insulate the enclosed ammunition from electrical storms and the like.

Accordingly, methods and systems are desired for improved ammunition containers that address one or more of the above challenges.

BRIEF SUMMARY

The present subject matter improved ammunition containers that incorporate advanced sealing/latching arrangements. In one embodiment, the ammunition container includes a cover assembly that separates the latching functionality from the sealing functionality such that the latching assembly is rotatably engaged and the cover seal is provided via radial (rather than axial) compression of an annular sealing component. In accordance with a further embodiment, the ammunition container includes a novel lightning mitigation system that also functions as a convenient method of grasping and transporting the container.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

Embodiments of the subject matter described herein generally relate to ammunition containers that incorporate a variety of desirable features, such as an advanced sealing/latching arrangement as well as a lightning mitigation scheme that exhibits a number of advantageous features. As discussed in further detail below, a cover assembly is provided that separates the latching functionality from the sealing functionality such that the latching assembly is rotatably engaged and the cover seal is provided via radial (rather than axial) compression of an annular sealing component. In addition, a novel lightning mitigation system is provided that also functions as a convenient method of grasping and transporting the containers.

Figure 1:
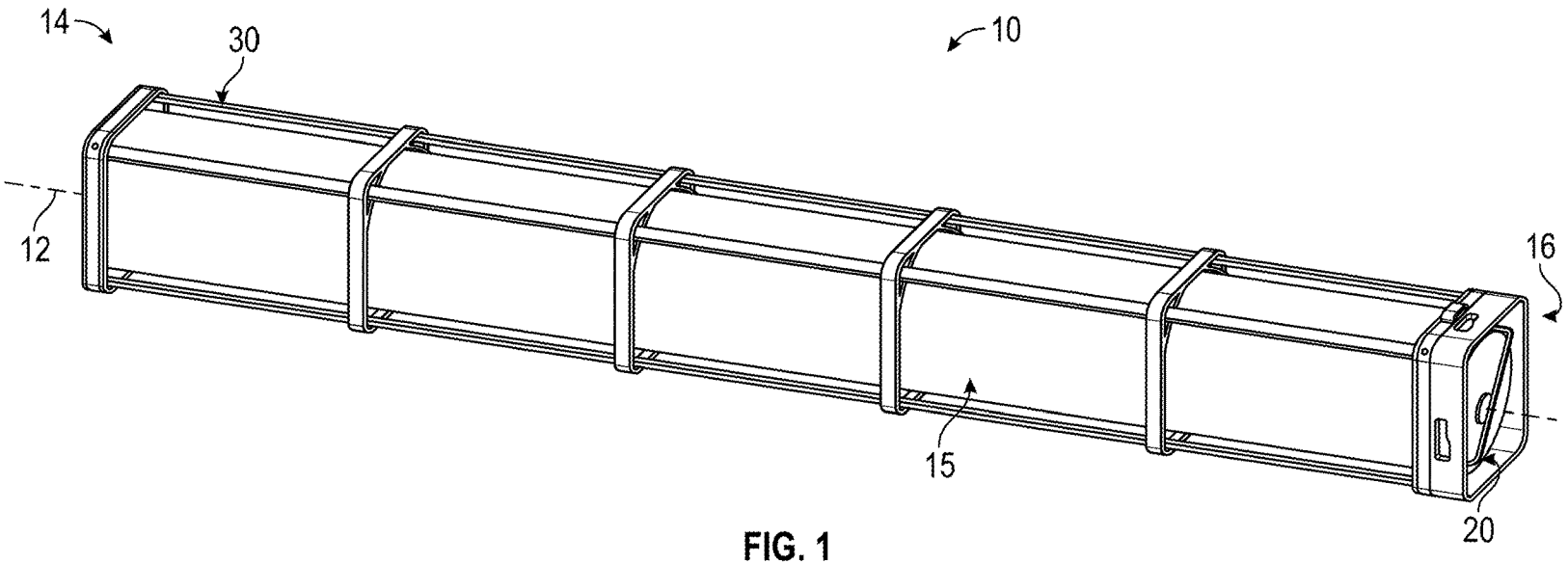
FIG. 1 is an isometric external overview of an ammunition container in accordance with one embodiment.

Referring now to the figures, FIG. 1 presents an isometric external overview of an ammunition container assembly 10 (also referred to herein as simply a "container" or "container assembly") in accordance with one embodiment of the invention. As shown, container 10 includes a generally elongated main body or simply "body" 15 that extends from a first end 14 to a second end 16 along a longitudinal axis 12. In that regard, the terms "longitudinal" and "radial" will be used herein to refer to a direction oriented orthogonal (perpendicular) to axis 12, while the term "axial" will be used to refer to a direction that is generally parallel to axis 12.

As a preliminary matter, it should be understood that the size, shape, and material selected for container 10 may vary, depending upon the ammunition that is to be housed within main body 15. Thus, while the illustrated embodiment may be described in the context of a container 10 configured to fit a "Hydra-70" type guided rocket or the like, those skilled in the art will understand that embodiments of the present invention may be used in the context of a wide variety of ammunition types, such as mortar rounds, tank rounds, artillery rounds, missiles, rockets, and/or various rocket and missile subcomponents. In one embodiment, for example, main body 15 is an HDPE pipe with a diameter of approximately 8.0 inches. In a particular embodiment, the inner diameter of main body 15 is approximately 8.31 inches, and the container 10 has an overall longitudinal length of about 83 inches. The invention is not so limited, however.

With continued reference to FIG. 1, container 10 generally includes a cover assembly 20 adjacent second end 16, through which the desired ammunition is to be loaded. As explained in further detail below, cover assembly 20 preferably includes a radial cover seal combined with a twist-lock cover (e.g., a cover that is engaged through approximately one fourth of a rotation). Container 10 also preferably includes a lightning mitigation assembly 30 (also referred to herein as "lightning mitigation components" or the like) that may include, for example, longitudinal lightning bars that may also function as carry-handles, as described in further detail below.

Figure 3:
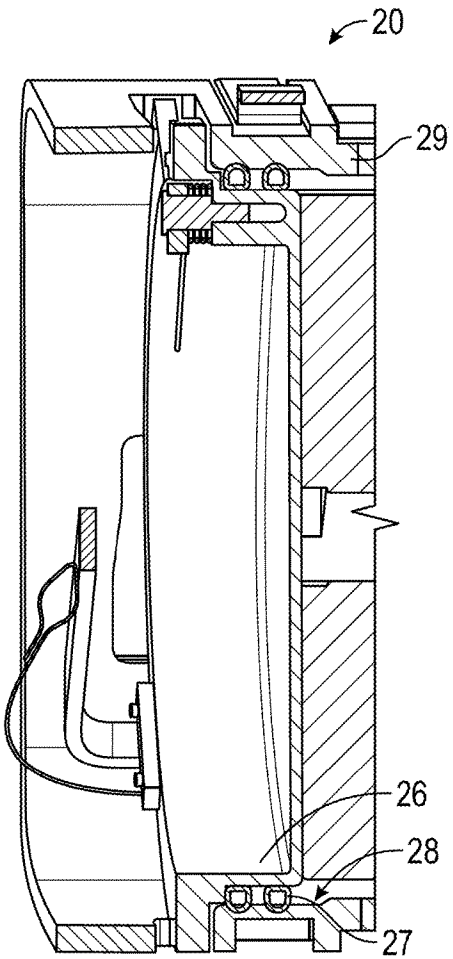
FIGS. 2 and 3 illustrate, respectively, end-on and side cut-away views of the container of FIG. 1.
Figure 2:
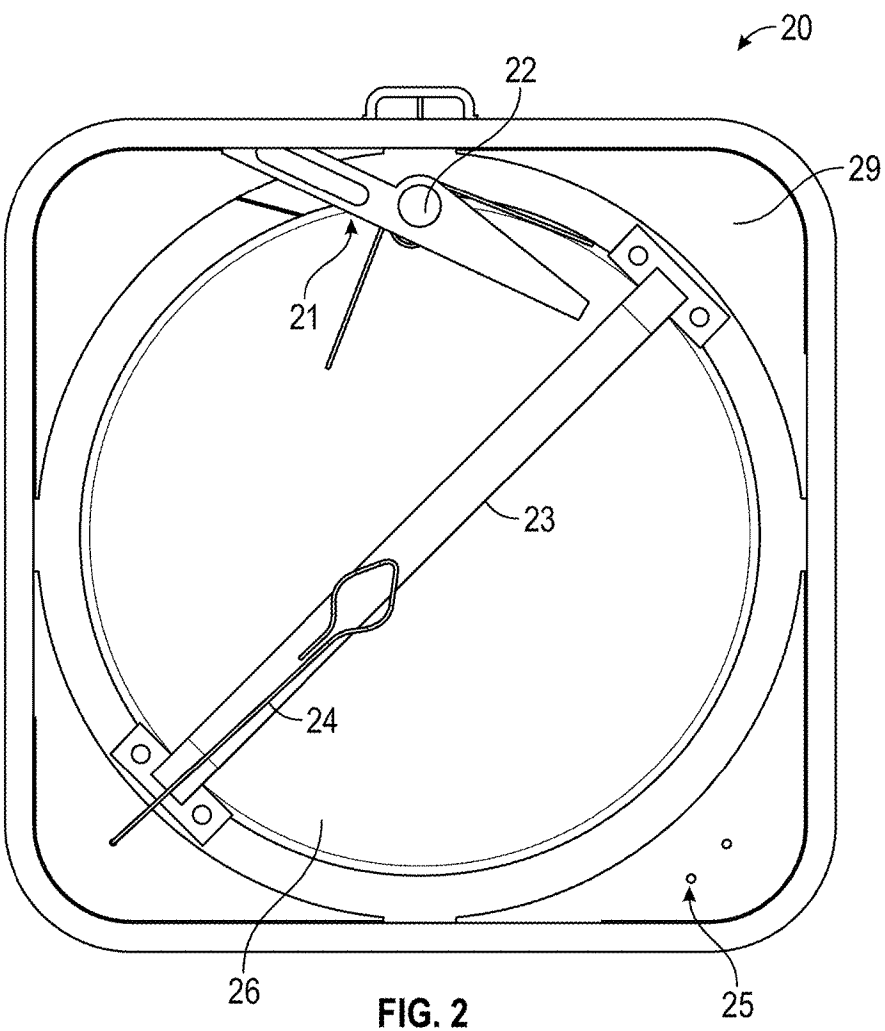

FIGS. 2 and 3 illustrate, respectively, end-on and side cut-away views of the container of FIG. 1. That is, FIG. 2 presents end 16 as viewed axially, and FIG. 3 illustrates a cross-sectional view that is perpendicular to FIG. 2. As shown in FIG. 2, cover assembly 20 generally includes a lockout dog (or simply "dog" 21) configured to rotate about a pin or other axial member 22 secured to a generally disc-shaped cover component (or "cover") 26 and which is configured to selectively engage the "inbox" structure 29. Cover assembly 20 further includes a handle 23 and, optionally, a lanyard component 24. As shown, inbox 29 may include one or more holes or other structures for securing anti-pilferage wire.

As shown in FIG. 3, cover 26 seats within a bore 28 of inbox 29 by virtue of an annular seal 27 provided therein such that, when cover 26 is inserted via an axial force (i.e., to the right in FIG. 3), sealing is provided by annular seal 27 by virtue of its compression in the radial direction (i.e., as opposed to strictly axial compression, as is conventional in the prior art).

Figure 4B:
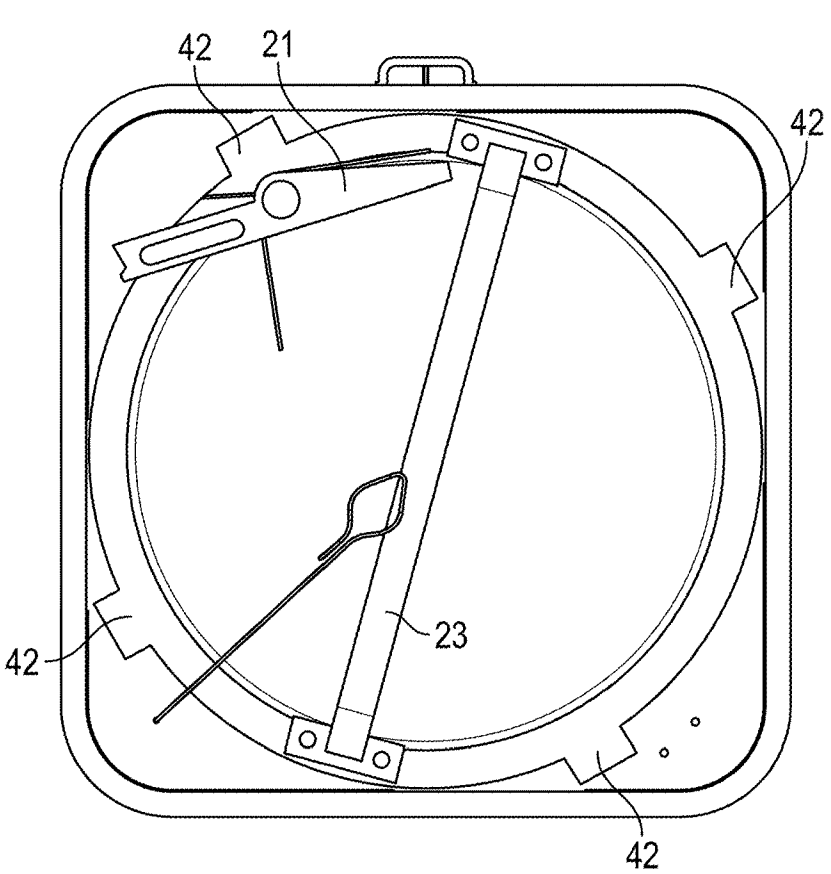
FIG. 4A-4C illustrate, sequentially, the manner in which the cover assembly may be disengaged.
Figure 4A:
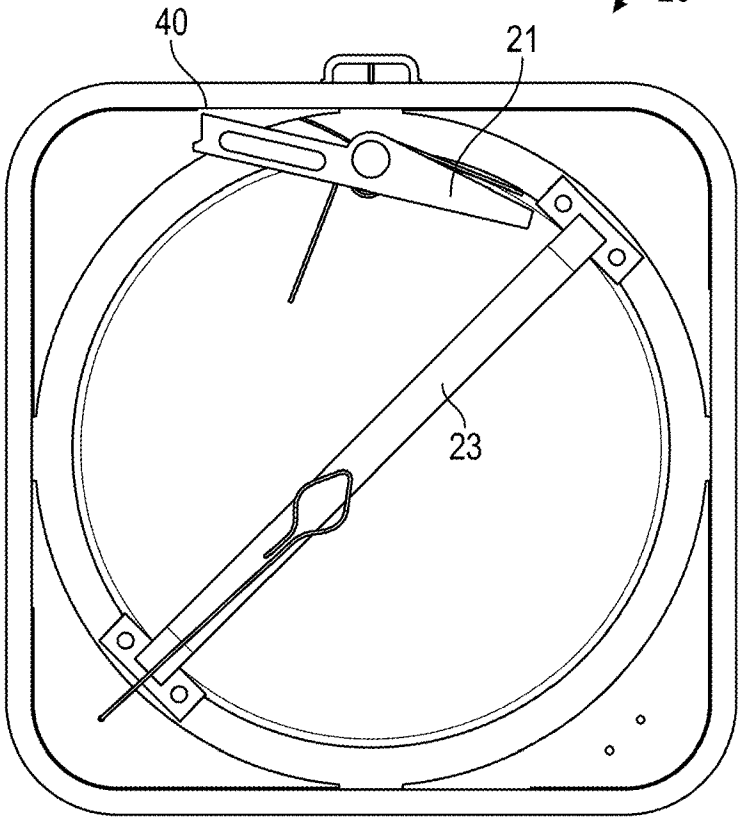
Figure 4C:
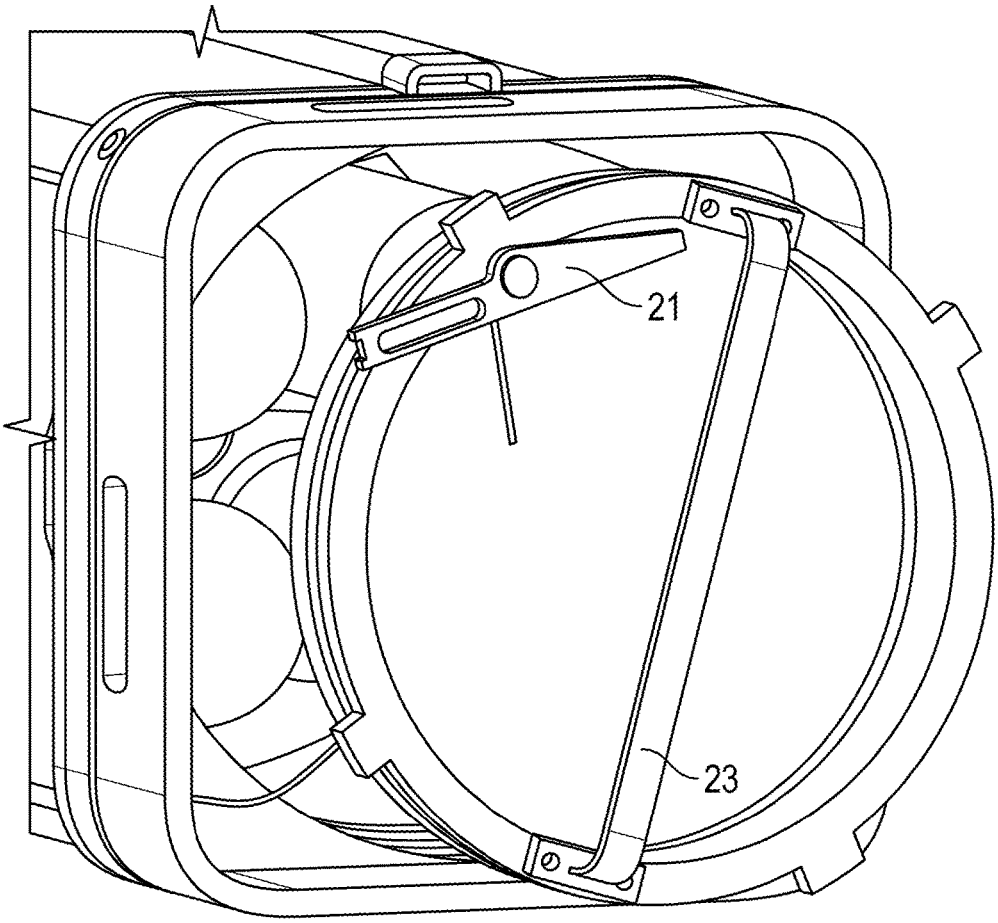

FIG. 4A-4C illustrate, sequentially, the manner in which the cover assembly 20 may be disengaged from inbox 29 (i.e., from a "closed" to an "open" state). First, as shown in FIG. 4A, dog 21 is released by the user by applying a generally radial or outward force to one end of dog 21 (which is suitably spring loaded, as shown), thus causing the opposite end of dog 21 to disengage from a latching edge 40 of a slot (not shown) that is incorporated into inbox 29.

Next, as shown in FIG. 4B, cover 26 is rotated (in this embodiment, counter-clockwise) by applying a moment force to handle 23. This allows one or more tabs 42 of cover 26 to rotate out of their respective slots, as shown. Note that while the illustrated embodiment shows four, rectangular-shaped tabs 42 distributed circumferentially at 90-degree intervals, the invention is not so limited: any number of tabs having any suitable shape may be used.

Finally, as shown in FIG. 4C, an axial pulling force (e.g., to the right in FIG. 4C as well as FIG. 1) is applied to handle 23, allowing cover 26 to be removed from inbox 29 and thereby exposing the cavity therein. Cover 26, dog 21, seal 27, and inbox bore 28 (shown in FIG. 3) may be designed to require any desired combination of rotational forces and pull forces. In one embodiment, for example, about 4.0 lbf is required to release dog 21 from inbox 29.

As will be appreciated, cover assembly 20 as shown in FIGS. 4A-4C is desirable in that the process of sealing container 10 is effectively separated from the process of latching cover 26 into cover assembly 20. That is, latching is accomplished via radial movement (in conjunction with dog 21), while sealing is provided via axial movement in conjunction with radial compression of seal 27. The latch arrangement itself does not provide the sealing force. It will be appreciated that this embodiment is desirable in that opening and closing of cover assembly 20 can also be accomplished by an operator using one hand, rather than two.

Figure 5A:
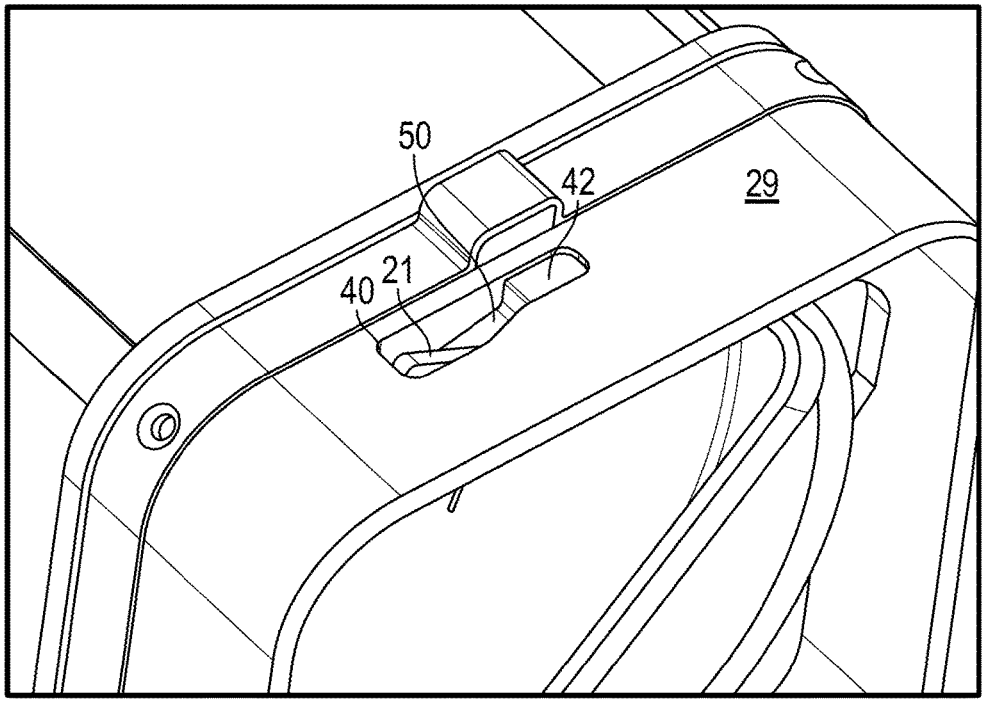
FIGS. 5A and 5B depict top and underside views of an inbox that shows the manner in which the lockout dog engages the inbox when in the closed position.
Figure 5B:
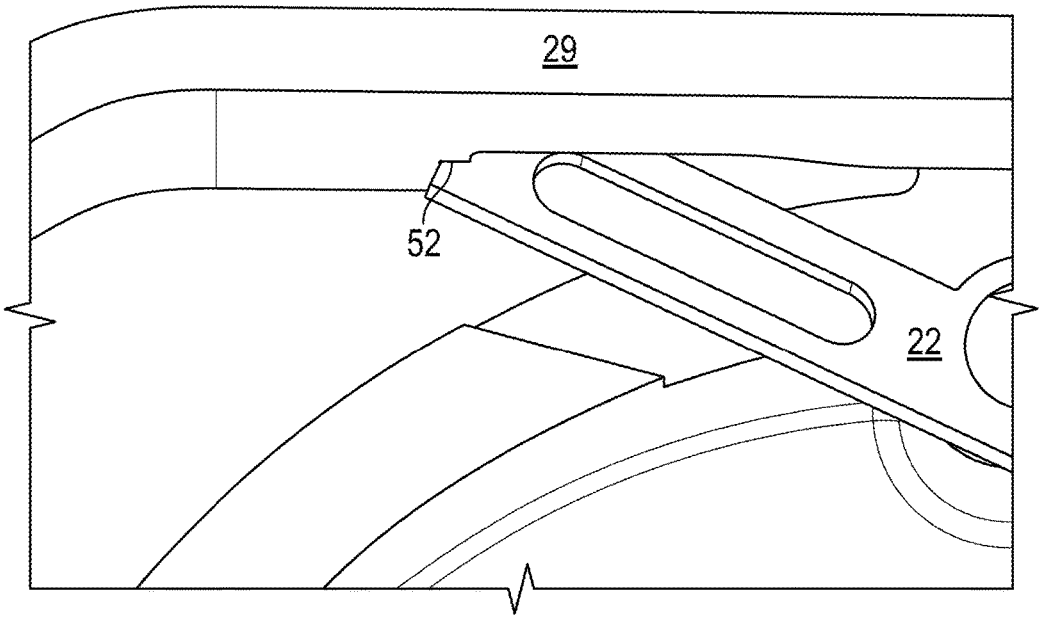

FIGS. 5A and 5B depict top and underside views of a top edge of inbox 29 that show the manner in which dog 21 engages inbox 29 when in the closed position. That is, FIG. 5A shows one end of dog 21 impinging on one edge 40 of a generally rectangular slot formed in inbox 29 as shown. A cam surface 50 "cams" cover 26 to ensure compression of the interior dunnage, and, as shown in FIG. 5B, an "upstop" 52 is provided at the end of dog 21 to prevent over-rotation (clockwise) with respect to inbox 29.

Figure 6:
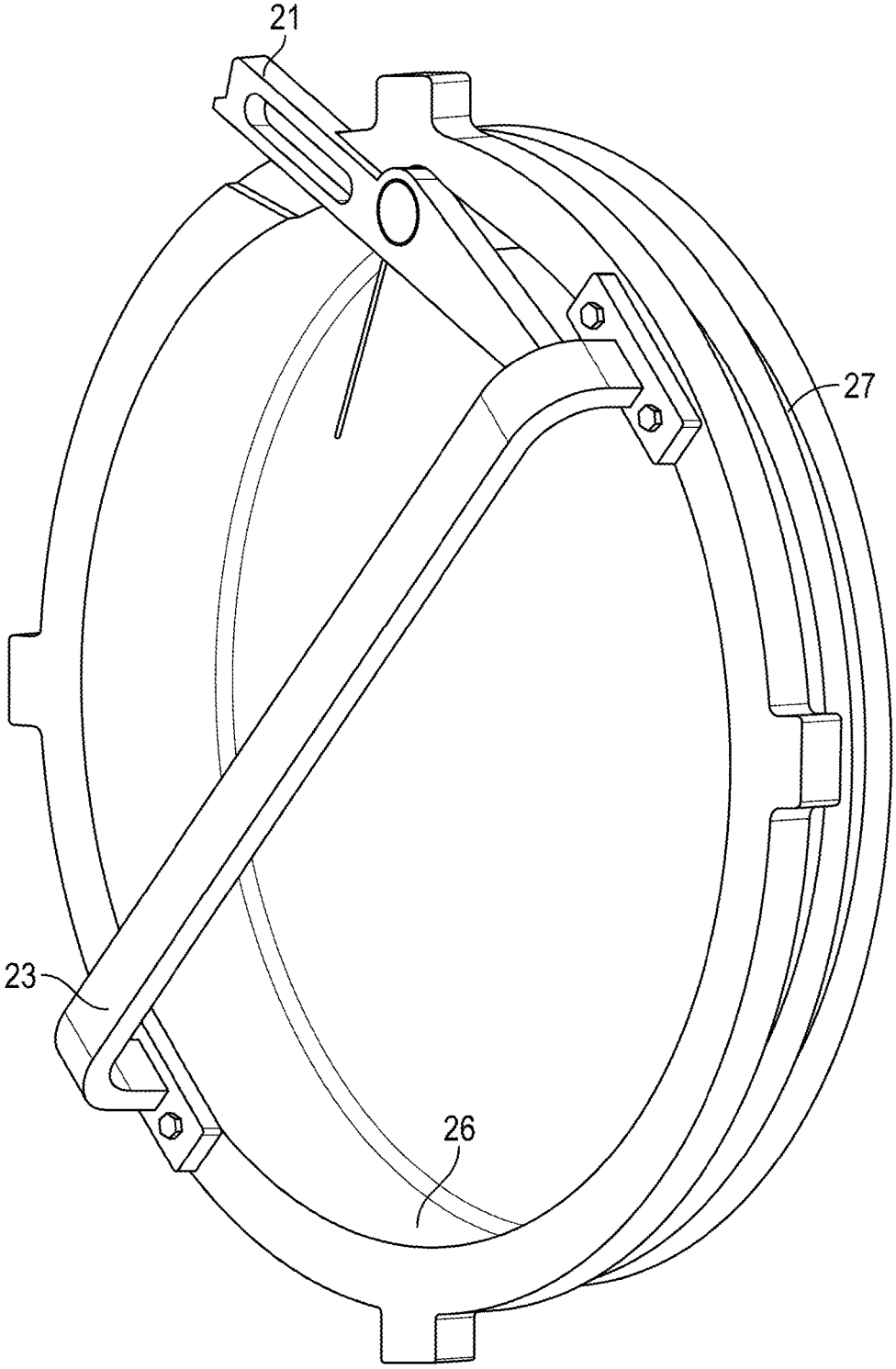
FIG. 6 is an exterior view of a portion of a cover assembly.
Figure 7:
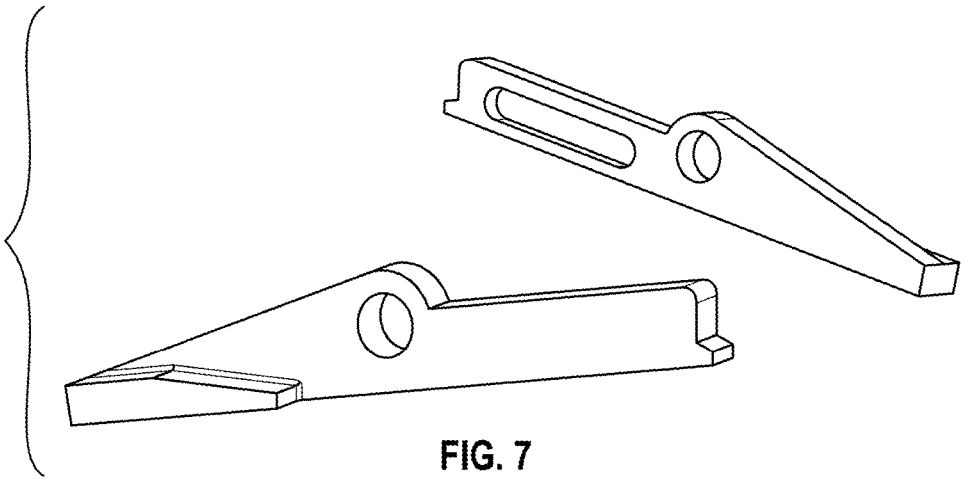
FIG. 7 is a close-up of an exemplary dog, illustrating where the leg of the torsion spring impinges, and where the operator pushes the dog in order to release it.

FIG. 6 is an alternate view of the cover 26, dog 21, and seal 27 shown in FIGS. 2 and 3, disengaged from inbox 29. As shown, one end of a torsion spring is also shown extending from dog 21 (i.e., prior to being moved to its final position within the assembly). Handle 23 may be secured to cover 26 in any convenient manner, including for example, peening cast posts that interface with holes provided within handle 23, as shown. Cover 26 may be formed from any suitable material, such as aluminum, plastic, or the like. FIG. 7 is simply a close-up of an exemplary dog 21, illustrating the location at which the leg of the torsion spring impinges, and where the operator pushes the dog 21 to release the assembly.

Figure 8:
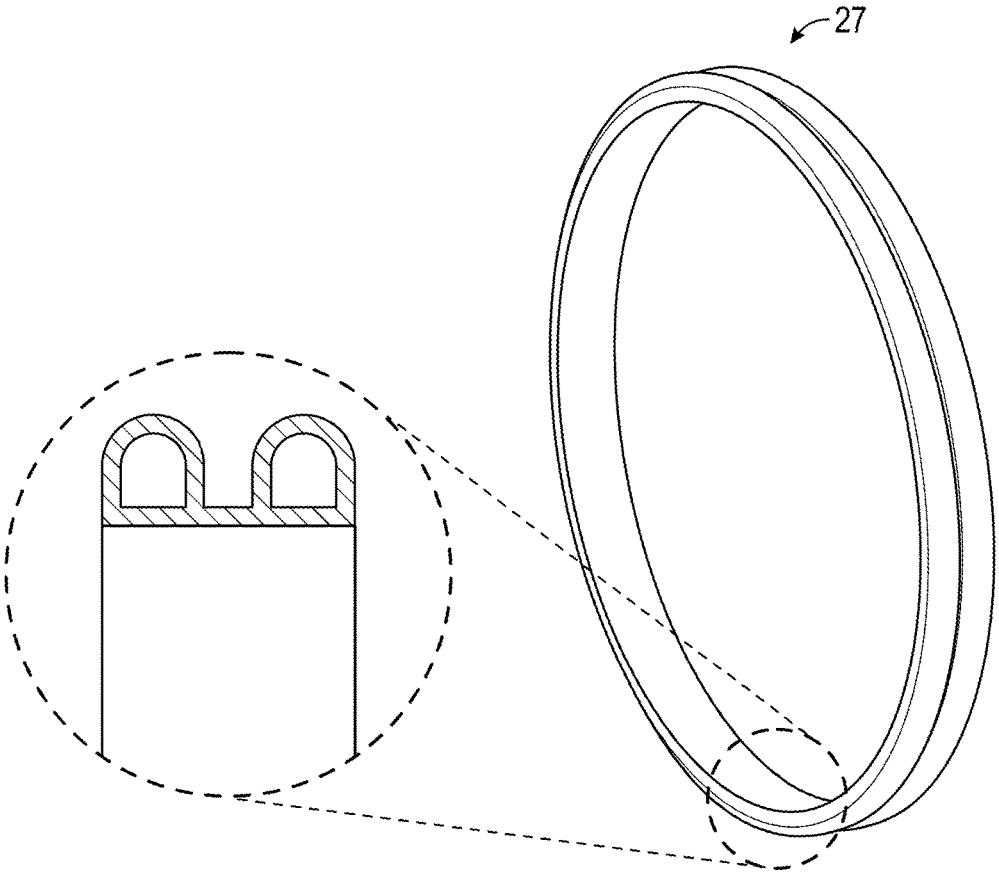
FIG. 8 is an isometric overview of an exemplary seal and an inset cross-sectional view.

FIG. 8 is an isometric overview of an exemplary seal 27, along with an inset cross-sectional view. In this embodiment, seal 27 is a hollow, double-bulb seal as shown, having a general "B" shaped cross-section. In one embodiment, seal 27 is manufactured from extruded stock vulcanized into a circular form, but may be formed from a variety of suitable materials known in the art. It will be appreciated that, after sealing, the top surfaces of the double-bulb structure (inset) will be subject to a radial outward force that will cause radial deformation, thereby sealing the assembly. The use of a double-bulb arrangement provides additional sealing capabilities over and above a single bulb arrangement. However, the invention is not so limited, and comprehends any suitable seal structure configured to be deformed radially.

Figure 10:
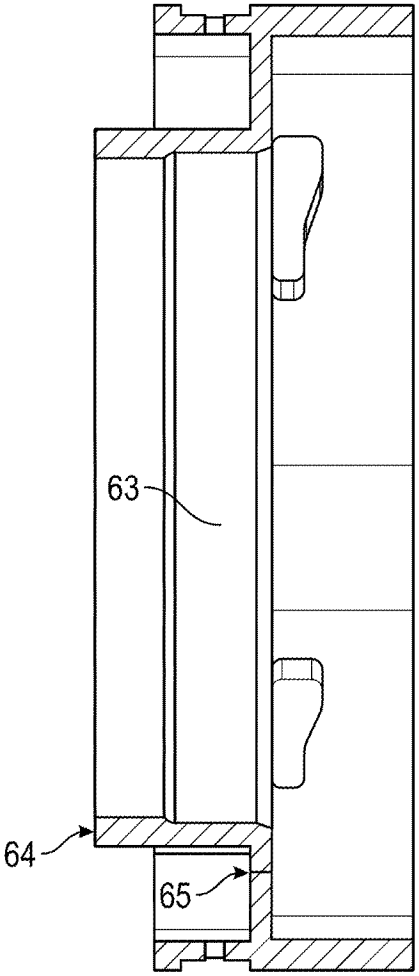
FIGS. 9 and 10 illustrate, respectively, an isometric view and a cross-sectional view of an exemplary inbox 29.
Figure 9:
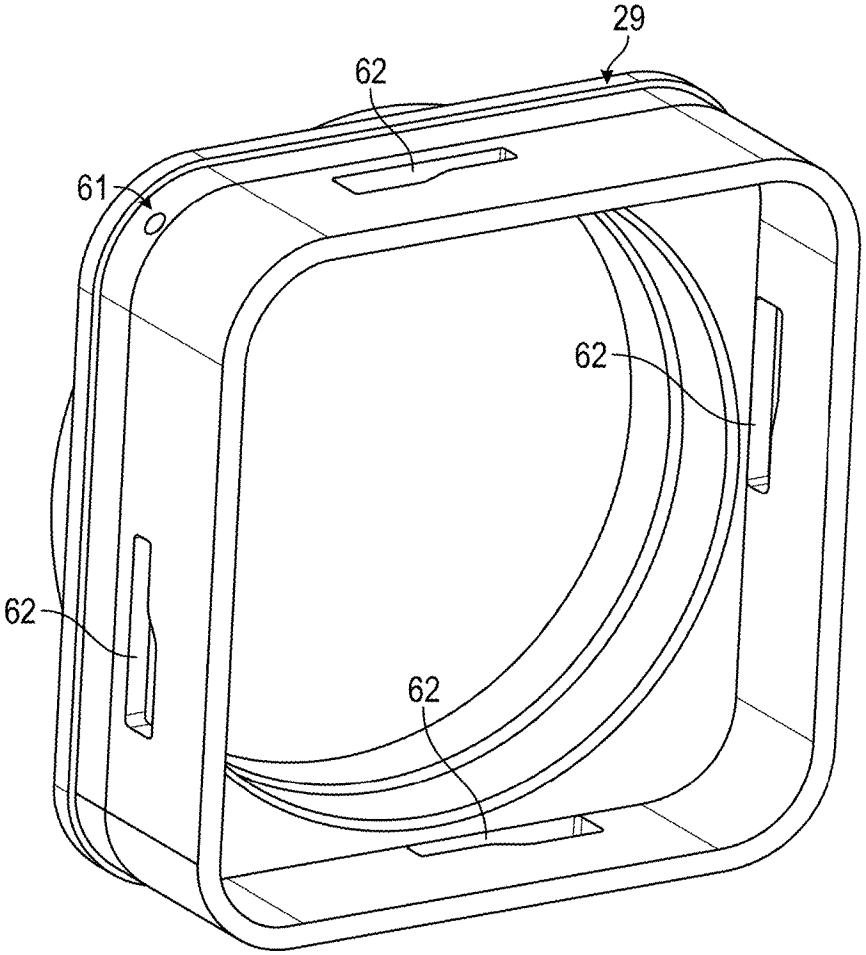

FIGS. 9 and 10 illustrate, respectively, an isometric view and a 45-degree cross-sectional view of an exemplary inbox 29. As shown, inbox 29 may included screw-holes 61 for attaching one or more (e.g., four) lightning bands or bars, as discussed in further detail below. FIG. 9 also illustrates four cover latching slots 62 (as referred to previously in FIG. 5A). FIG. 10 illustrates the nature of seal bore 63 as well as fusion welding surface 64 and a hole 65 for a cover lanyard (not shown).

Figure 11:
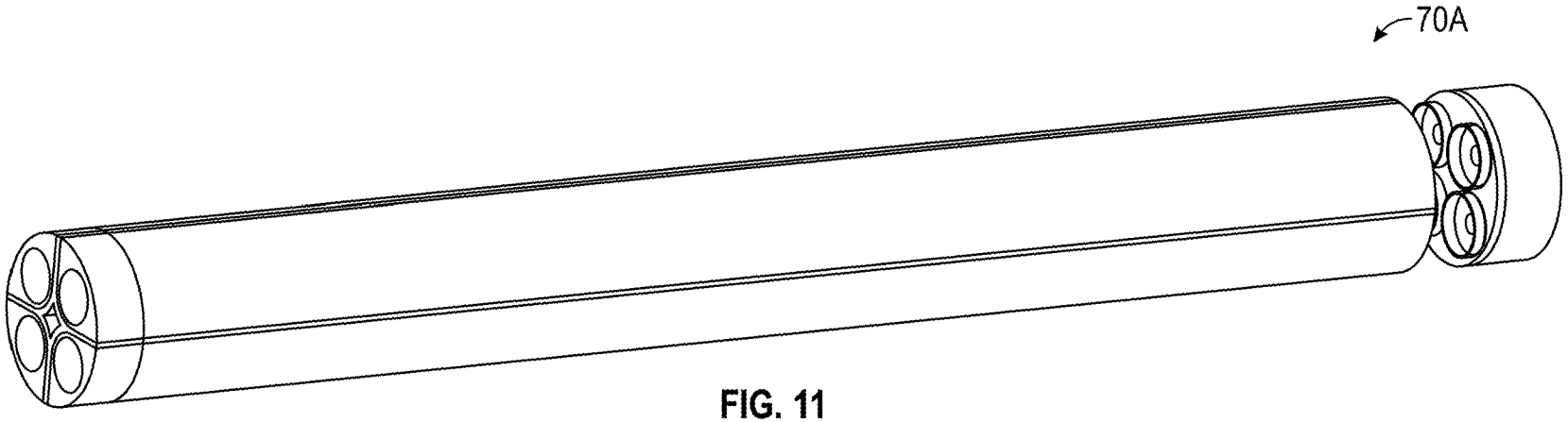
FIG. 11 illustrates a four-rocket dunnage, with isolation, in accordance with one embodiment.
Figure 12:
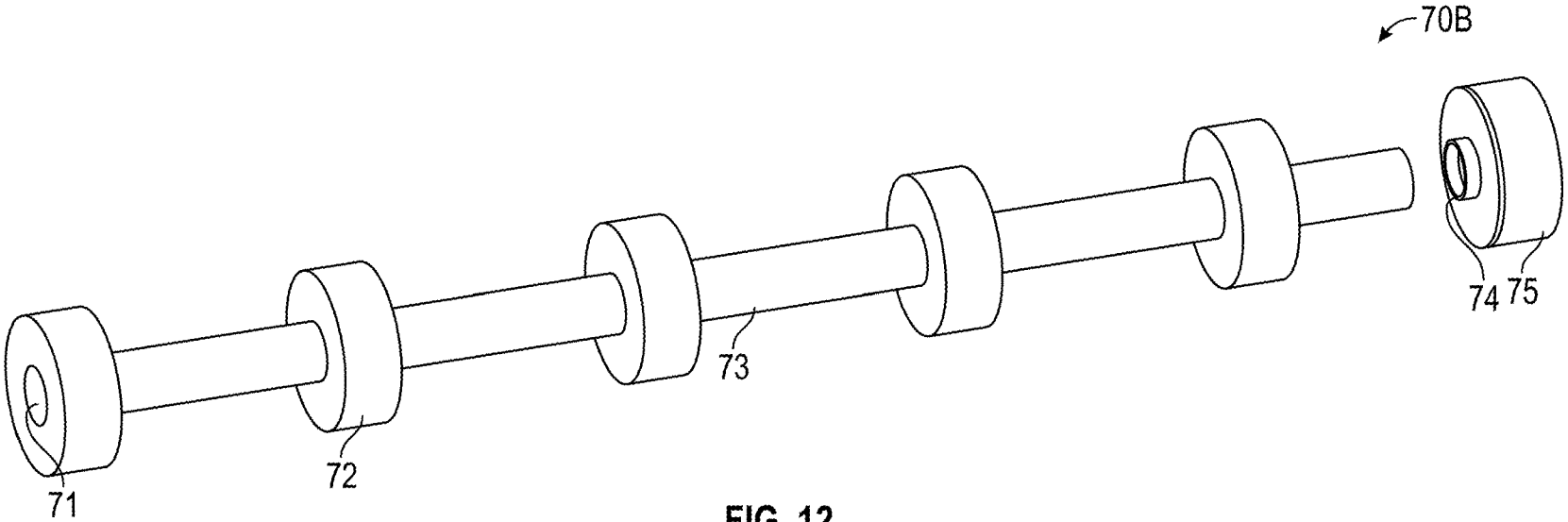
FIG. 12 depicts a single rocket dunnage in accordance with one embodiment.

FIG. 11 illustrates a four-rocket dunnage 70A, with isolation, in accordance with one embodiment, and FIG. 12 depicts a single rocket dunnage 70B. That is, referring to FIG. 12, single rocket dunnage 70B may incorporate a foam nose cushion 71 that fits within the main body tube 15 (FIG.

1), a number (e.g., five) foam cushion collars 72, an inner tube extrusion 73, a load spreader 74, and a cover cushion 75.

Figure 13:
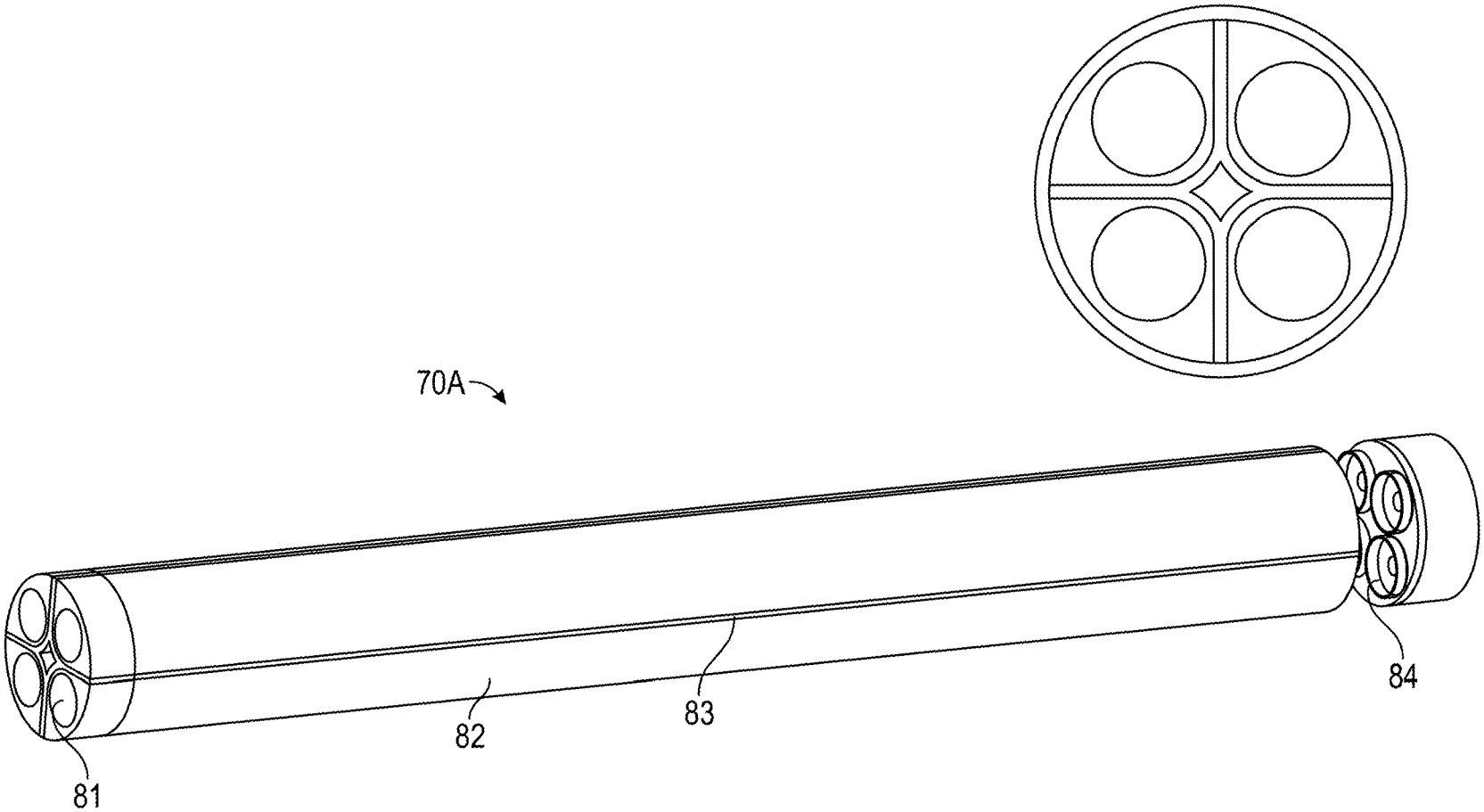
FIG. 13 illustrates the four-rocket dunnage FIG. 11 in greater detail.
Figure 14:
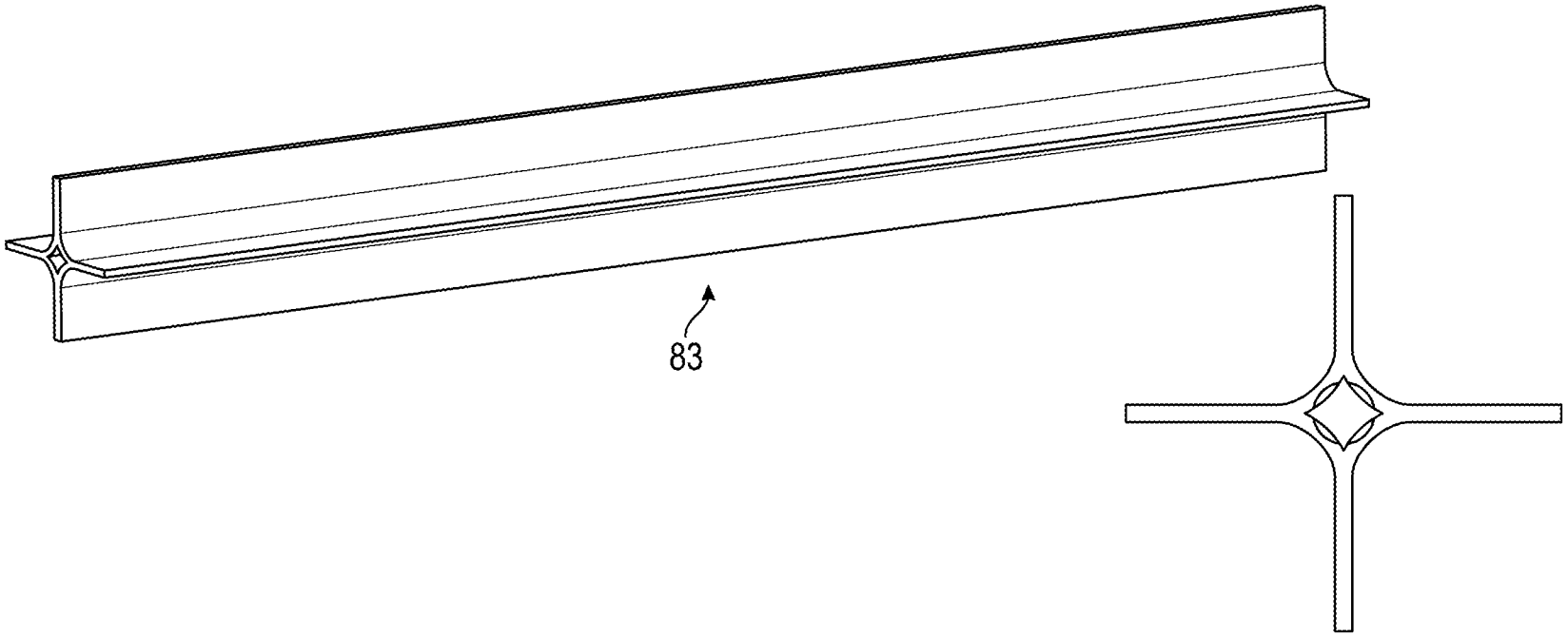
FIG. 14 illustrates an exemplary isolator in greater detail.

FIG. 13 illustrates the four-rocket dunnage 70A of FIG. 11 in greater detail. In this embodiment, as shown, assembly 70A includes nose cushions (e.g., four cushions) 81, which may have a reduced diameter to clear a welding bead, if applicable. Assembly 70A also includes four foam strips 82, an isolator 83 (i.e., for sympathetic detonation (SD) isolation), and a plastic load spreader 84. Foam strips 82 preferably provide radial cushioning and does not require an inner tube. Isolator 83 and foam strips 82 may be suitably secured to each other (e.g., via an adhesive) so that the two components can be treated as one unit to easily slide within the main body 15 of container 10. FIG. 14 illustrates isolator 83 in greater detail, illustrating a threaded hole for an extraction tool to ease removal of isolator, and a nose end cut down to clear a weld bead, if necessary.

Figure 15:
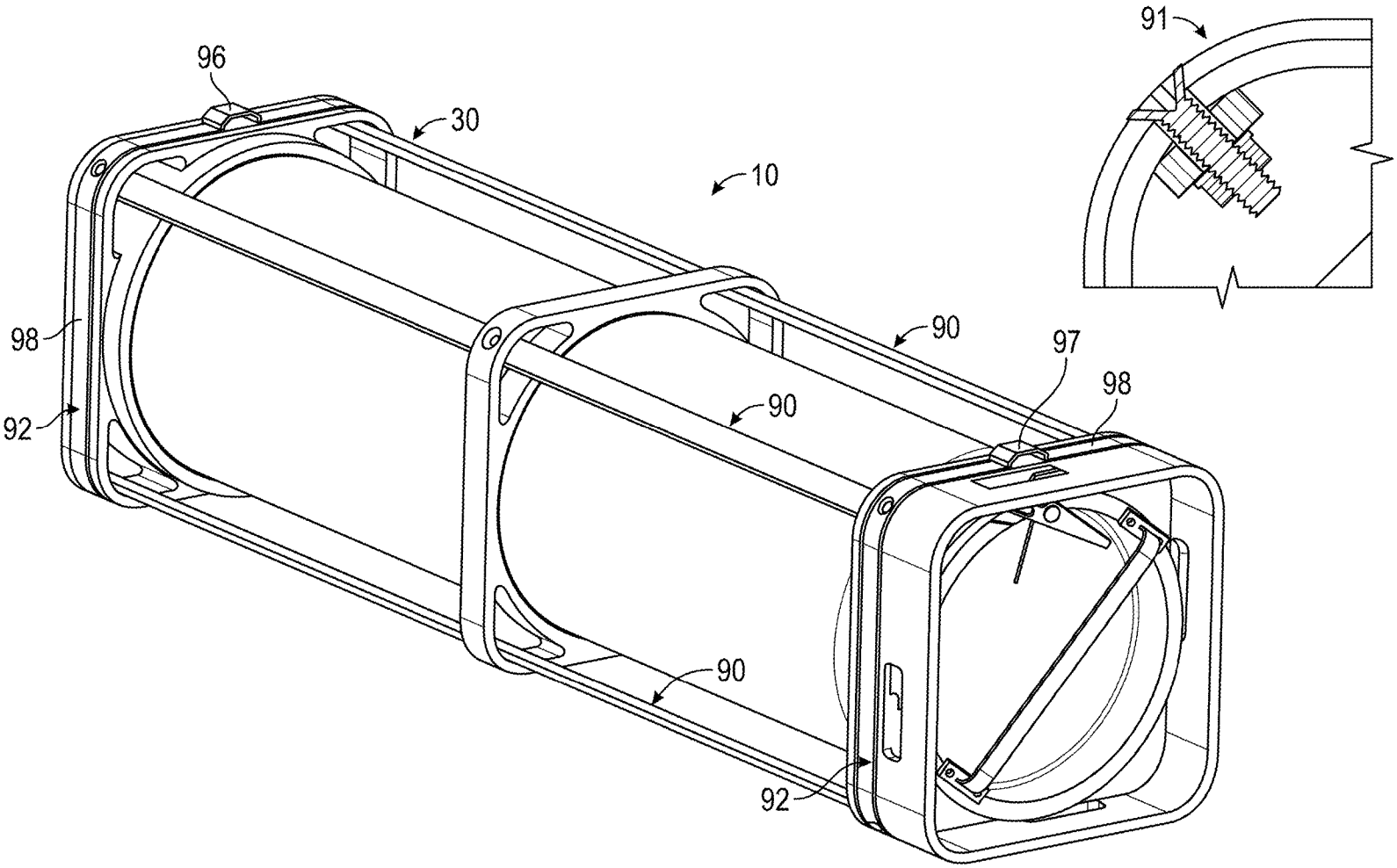
FIG. 15 illustrates various components of a lightning mitigation system.

FIG. 15 illustrates various components of a lightning mitigation system 30 referenced previously. That is, in embodiments in which main body 15 is plastic or otherwise substantially non-conductive, it is desirable to provide some sort of protection against electrical events that might damage or initiate the enclosed ammunition. Accordingly, assembly 30 in this embodiment includes one or more conductive bars (or "bands") 90 that extend longitudinally and are distributed at the corners of the structure. In the illustrated embodiment, four such bars 90 are employed; however, the invention is not so limited. Bars 90 may be formed from any suitable conductive material, such as stainless steel braided sleeving or solid conductive metal bars.

Figure 16:
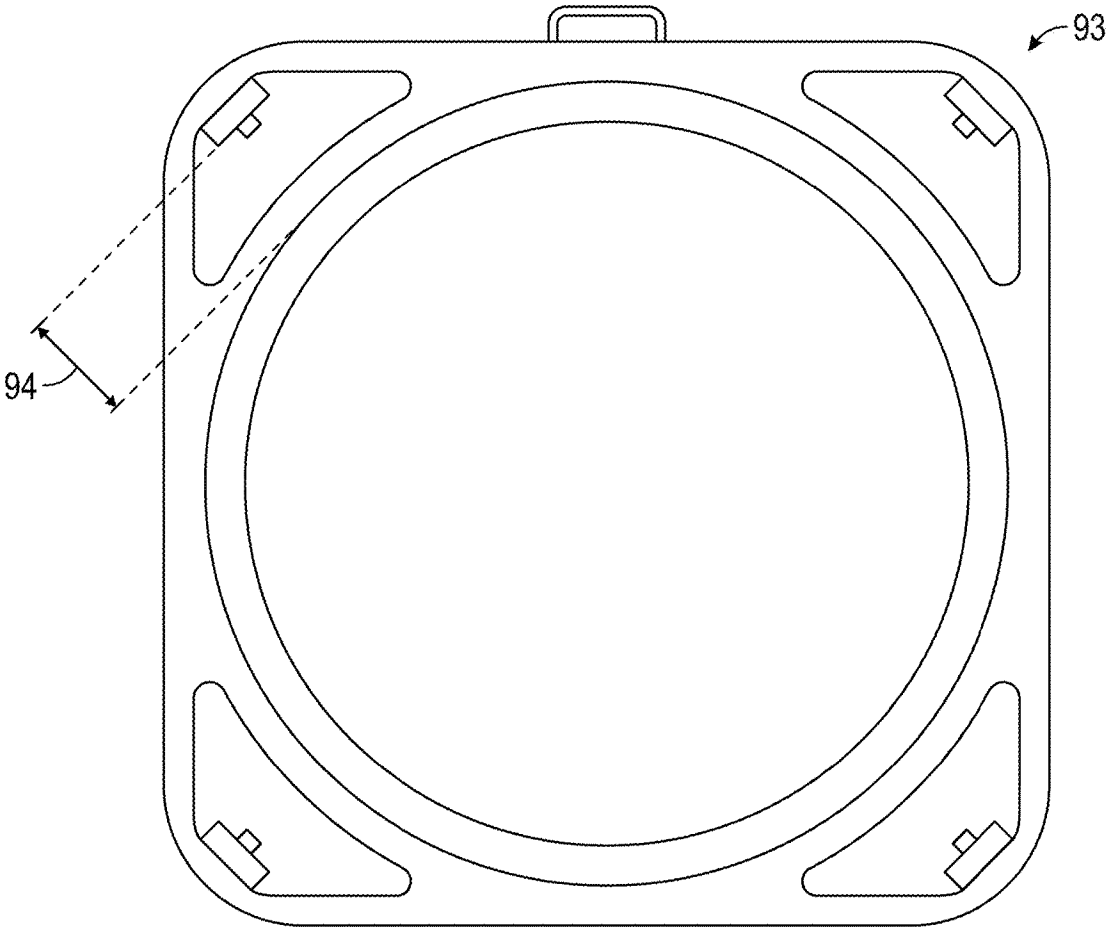
FIG. 16 illustrates an end-on view of the lightning mitigation system of FIG. 15.

Assembly 30 further may include tabs 96 and 97 that are configured to fit within respective slots in other containers 10, thereby allowing multiple containers 10 to be stacked on top of each other in an advantageous fashion. Assembly 30 also preferably includes circumferential bars or bands 98 that can be electrically interconnected to bars 90. The inset image illustrates a securing method 91 for providing interconnection between bars 90 and 98—in this case a conductive screw that extends through the housing to contact each of the bars. In this way, the lightning assembly 30 comprises a single, conductive electrical node. FIG. 16 illustrates an end on view of the container shown in FIG. 15. In this view, it can be seen that bars 90 in one embodiment is separated from the main body by a distance that provides clearance (e.g., about 3.0 inches) for a human hand wearing a predetermined type of glove, such as a MOPP 4 mitten to conform to MIL-STD-1472 recommendations. This allows container 10 to be easily grasped and moved by the operator.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application. Accordingly, details of the exemplary embodiments or other limitations described above should not be read into the claims absent a clear intention to the contrary.

What is claimed is:

1. A container assembly comprising:

a generally elongated main body extending from a first end to a second end;

a cover assembly provided at the second end of the main body and configured to selectably provide access to an interior region of the main body;

wherein the cover assembly includes a cover component having a locking assembly coupled thereto, the locking assembly configured to rotate about an axial member secured to the cover component and configured to selectively engage a portion of the main body;

an annular sealing component provided between the cover component and the main body, wherein a seal is provided by virtue of radial compression of the annular sealing component between the cover component and the main body; and the locking assembly includes a spring-loaded lockout dog releasable via a radial outward force applied to one end of the lockout dog.

2. The container assembly of claim 1, wherein the interior region of the main body is adapted to house ammunition selected from the group consisting of a guided rocket, a mortar round, a tank round, an artillery round, a missile, and a rocket.

3. The container assembly of claim 1, wherein the cover component includes a plurality of periphery tabs configured to selectively seat within a corresponding plurality of slots in the main body and to be rotatably released therefrom.

4. The container assembly of claim 1, wherein the main body comprises high-density polyethylene.

5. The container assembly of claim 1, wherein the main body has a diameter of approximately 7.0-9.0 inches, an inner diameter of approximately 7.0-9.0 inches, and a longitudinal length of about 83.0 inches.

6. The container assembly of claim 1, further including a lighting mitigation system incorporated into the exterior of the main body.

7. The container assembly of claim 6, wherein the lightning mitigation system includes one or more longitudinal conductive lightning bars.

8. The container assembly of claim 7, wherein the longitudinal conductive lightning bars are configured such that they may be grasped by a human hand wearing a glove of a predetermined type.

9. The container assembly of claim 7, wherein the lightning mitigation system includes four longitudinal conductive lightning bars distributed at corresponding longitudinal corners of the main body.

10. A cover assembly for providing access to a main body of an ammunition container, the cover assembly including:

a cover component having a locking assembly coupled thereto, the locking assembly configured to rotate about an axial member secured to the cover component and configured to selectively engage a portion of the main body of the ammunition container;

an annular sealing component provided between the cover component and the main body, wherein a seal is provided by virtue of radial compression of the annular sealing component between the cover component and the main body, and removal of the cover component is accomplished via an axial force applied to a handle coupled to the cover component; and wherein the locking assembly includes a spring-loaded lockout dog releasable via a radial outward force applied to one end of the lockout dog.

11. The cover assembly of claim 1, wherein the cover component includes a plurality of periphery tabs configured to selectively seat within a corresponding plurality of slots in the main body and to be rotatably released therefrom.

12. An ammunition container assembly comprising:

a generally elongated main body extending from a first end to a second end;

a cover assembly provided at the second end of the main body and configured to selectably provide access to an interior region of the main body;

wherein the cover assembly includes a cover component having a locking assembly coupled thereto, the locking assembly configured to rotate about an axial member secured to the cover component and configured to selectively engage a portion of the main body; and an annular sealing component provided between the cover component and the main body, wherein a seal is provided by virtue of radial compression of the annular sealing component between the cover component and the main body;

a lightning mitigation system coupled to the main body of the ammunition container, the lightning mitigation including a plurality of conductive longitudinal bars; and wherein the locking assembly includes a spring-loaded lockout dog releasable via a radial outward force applied to one end of the lockout dog.

13. The ammunition container assembly of claim 12, wherein the interior region of the main body is adapted to house ammunition selected from the group consisting of a guided rocket, a mortar round, a tank round, an artillery round, a missile, and a rocket.

14. The ammunition container assembly of claim 12, wherein the cover component includes a plurality of periphery tabs configured to selectively seat within a corresponding plurality of slots in the main body and to be rotatably released therefrom.

15. The ammunition container assembly of claim 12, wherein the longitudinal conductive lightning bars are configured such that they may be grasped by a human hand wearing a glove of a predetermined type.

16. The ammunition container of claim 15, wherein the longitudinal conductive lightning bars are separated from the main body such to conform to MIL-STD-1472 recommendations.

17. The ammunition container assembly of claim 15, wherein the lightning mitigation system includes four longitudinal conductive lightning bars distributed at corresponding longitudinal corners of the main body.

18. The ammunition container assembly of claim 12, wherein the interior region of the main body is adapted to house multiple ammunition components.

* * * * *